United States Patent [19]

Trützschler

[11] 4,187,584

[45] Feb. 12, 1980

[54] METHOD AND APPARATUS FOR OPENING TEXTILE FIBER BALES

[75] Inventor: Hermann Trützschler, Mönchen-Gladbach, Fed. Rep. of Germany

[73] Assignee: Trützschler GmbH & Co. KG, Mönchen-Gladbach, Fed. Rep. of Germany

[21] Appl. No.: 932,502

[22] Filed: Aug. 10, 1978

[30] Foreign Application Priority Data

Aug. 19, 1977 [DE] Fed. Rep. of Germany ..... 2737434

Sep. 17, 1977 [DE] Fed. Rep. of Germany ..... 2742016

[51] Int. Cl.[2] ..... D01G 7/06

[52] U.S. Cl. ..... 19/81; 19/145.5

[58] Field of Search ..... 19/80 R, 81, 145.5; 209/599; 73/78, 81, 85; 177/119–121

[56] References Cited

U.S. PATENT DOCUMENTS 3,660,866 5/1972 Jagst ..... 19/81

FOREIGN PATENT DOCUMENTS 46-1340 1/1971 Japan ..... 19/80 R

*Primary Examiner*—Louis Rimrodt

*Attorney, Agent, or Firm*—Haseltine, Lake & Waters

[57] ABSTRACT

An arrangement for opening textile fiber bales in which a row of bales are broken up from their underside. The device which performs the breaking-up process has revolving pairs of needle tables or rollers with needles inclined in relation to the working direction, so that with adjacent break up members they are inclined in the opposite direction. The rotary speed of the needle table is variable, and the rotary speed of one needle table of at least one pair of tables or rollers is changed as a function of material-specific property of the textiles fiber bales. The rotary speed may be changed automatically during operation. An input control parameter is obtained from the textile fiber bales to generate an input variable for the rotary speed of tne needle table, through a control unit. The hardness of the textile fiber bales may be used as the input control parameter. The weight of the bales may also be used for this purpose of providing the input control parameter.

7 Claims, 3 Drawing Figures

METHOD AND APPARATUS FOR OPENING TEXTILE FIBER BALES

BACKGROUND OF THE INVENTION

The present invention relates to a method for opening textile fiber bales in which a row of textile fiber bales are broken up from their underside. The breaking-up elements comprise revolving pairs of needle tables or rollers whose needles are inclined in relation to the working direction such that with adjacent breakup elements they are inclined in the opposite direction. The speed of rotation is variable. An apparatus for implementing the method is provided.

With this known method, all needle tables are driven at the same speed in the same direction. The hourly output may be influenced by changing the running speed of the needle tables. The speed of all needle tables is either increased or reduced. In practice, the uniform break-up depends on the varying quality of the textile fiber bales. It is frequently found that individual bales are much harder to break up than the other bales so that the amount of detached fiber flakes for these bales is smaller. Such bales are less "receptive to opening" which may be attributed to increased hardness, pressing or moisture.

It is, therefore, an object of the present invention to provide a method and apparatus of the above-mentioned type which permit a uniform break-up of all textile fiber bales, including individual bales which are difficult to break up.

Another object of the present invention is to provide an arrangement, of the foregoing character, which is simple in construction and may be economically fibracated.

A further object of the present invention is to provide an arrangement, as described, which has a substantially long operating life.

SUMMARY OF THE INVENTION

The objects of the present invention are achieved by varying the rotary speed of one needle table of at least one pair of needle tables or rollers as a function of material-specific properties of fiber bales.

The concept of the invention is to increase the ability to open individual bales which are difficult to break up. This can be accomplished by having one needle table of a pair of needle tables briefly run more quickly than the other needle table. It is advantageous to choose, for this procedure, that needle table whose needles point in the working direction. As a result, the needles of this needle table, which with normal operation would get stuck in the textile fiber bale and would move relative to the textile fiber bale only when switching to the deflector guide rollers, move inside the textile fiber bale. This tears open the surface layer of the textile fiber bale into which the needles have penetrated so that this layer can be detached more easily. In this manner, the breakup of a harder bale keeps up with the breakup of the remaining bales so that the detached quantitied of fiber flakes are the same. This measure can be used either with fixed needle tables and moving bales, or with traveling needle tables and stationary bales. In case of installations with several pairs of needle tables, individual needle tables of different pairs may be accelerated simultaneously or successively.

In order to avoid separate monitoring by operating personnel and manual actuation of the acceleration, the rotary speed is changed automatically during the operation of the installation. For this purpose, it is advantageous to automatically obtain from the textile fiber bales a disturbance magnitude (input control parameter), i.e., the bales with particularly low opening propensity are found. From this distrubance magnitude, via a control unit, an input control variable for the rotary speed of a certain needle table is determined, so that the surface layer of this bale can be torn open by accelerating. As disturbance magnitude, besides pressing tightness and moisture, the hardness and the weight may preferably be used or obtained.

Thus, an essential provision of the present invention is that a row of textile fiber bales are broken up from their underside, the break-up elements comprising revolving pairs of needle tables or rollers whose needles are inclined in relation to the working condition so that with adjacent break-up elements they are inclined in the opposite direction. The speed of rotation is variable, and the rotary speed of one needle table of at least one pair of needle tables is changed as a function of material-specific properties of the textile fiber bales.

The present invention also includes an apparatus for implementing the method. With this device, a disturbance magnitude (input control parameter) is obtained from the textile fiber bale which is hard to open. The speed of the drive motor for the needle belt of the needle table whose needles are in contact with the textile fiber bale which is difficult to open, is accelerated via a control unit which has been fed a maximum hardness as the desired value. The apparatus may also be designed as a regulator. To determine hardness as distrubance magnitude, a hardness tester in the form of a needle roller is provided.

The method can be implemented very simply by identifying the fiber or bales difficult to break up as soon as possible after starting the process, for example, optically by means of height. On these fiber bales, circuit elements, for example, limit switches or light barriers, are mounted whose counterparts are fastened to the two deflection guide rollers of one of the needle tables. This method is simple and not easily subject to failure, and permits the modification of existing installations.

In a further embodiment of the present inveniton, a bale opener is provided in which the needle tables are stationary and the bales are moved. Each bale during the opening process moves to the foremost position in the working direction, i.e., to the position opposite the entry side, which as a rule is followed by a stepwise cleaner. This position is also occupied by hard-to-open bales which exceed adjacent bales in height. Above the foremost needle tables which are located on the side opposite the entry side, a measuring sensing device, for example, a light barrier with a light emitter and a photocell as receiver or the like is installed at a given or predetermined height. The light barrier is preferably attached above the last needle table. This height corresponds to the approximate height of a bale with normal opening facility at this position. The light barrier is connected to a drive motor, for example, a polyphase asynchronous motor which is capable of accelerating the rotary speed of the needle belt. If a bale which is difficult to open reaches the foremost position and covers the light beam of the light barrier, the last needle table is accelerated till the height of the bale is again below the light barrier. However, the action of the light barrier can be terminated upon attaining normal opening conditions. Preferably, the needle table can be accelerated in the opening direction since the inclination of the needles in this direction have a large break-up effect.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
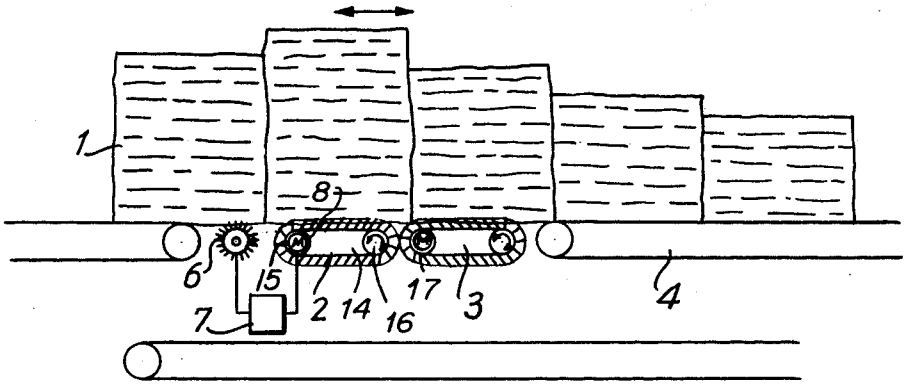
FIG. 1 is a schematic view and shows apparatus in accordance with the present invention with a hardness tester.

Referring to FIG. 1, two needle tables 2, 3 are located underneath a row of adjacent textile fiber bales 1; needle tables 2, 3 form one pair of needle tables. The length of each needle table 2, 3 is approximately equal to the length of one textile fiber bale 1. The textile fiber bales 1 lie directly on needle tables 2, 3 and are moved back and forth by them. During the break-up process, needle tables 2, 3 remain stationary. Bale transport tables 4, 5 are aligned with needle tables 2, 3 at the outer ends of the device. Between the bale transport table 5 and needle table 2, a needle roller 6 is provided as hardness tester. By means of the rotary needle roller 6 whose needles penetrate the surface layer of the textile fiber bales, various degrees of hardness are obtained as disturbance magnitude from the textile fiber bales 1. These hardness values are applied via a control unit 7 as input variable to the motor 8 which serves as correcting element. The motor 8 moves the needle belt of needle table 2. If a particularly hard bale passes the needle roller, a higher hardness value is reported to the control unit via a torque meter. The control unit compares this higher hardness value with a maximum hardness set in the control unit; if this maximum hardness is exceeded, a signal is applied to motor 8 whereupon motor 8 imparts a higher speed to the needle belt 14 of needle table 2. It is important that for a brief period, the needle tables 2, 3 rotate at different speeds. A motor 17 is employed to drive needle table 3.

Figure 2:
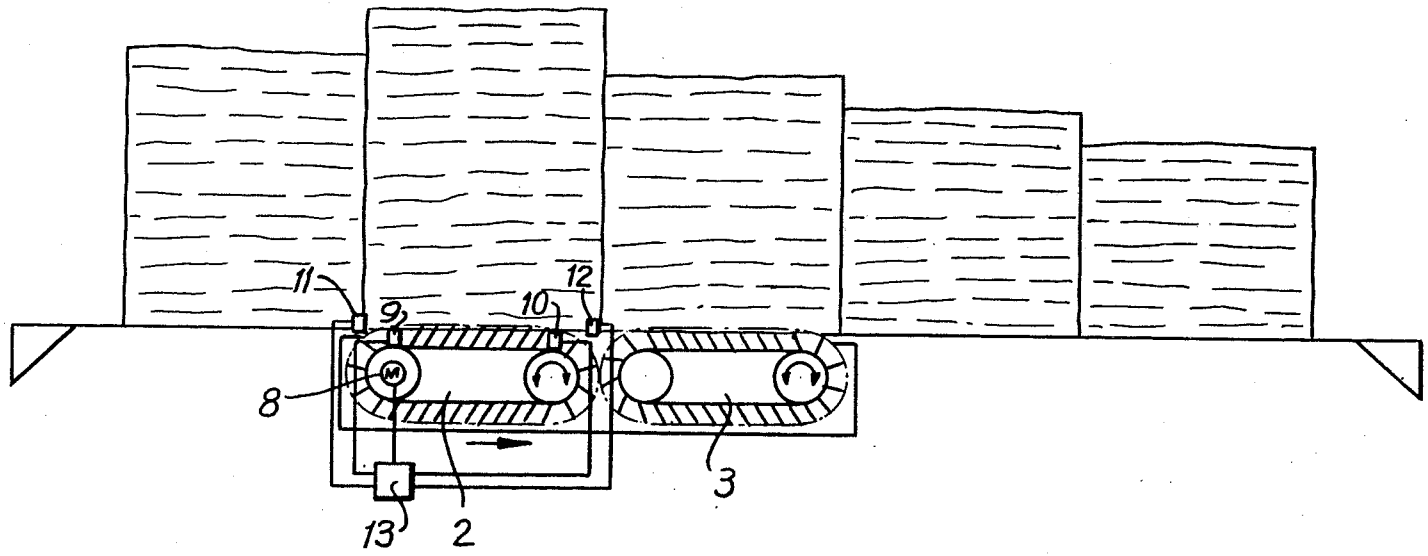
FIG. 2 is a schematic view and shows apparatus in accordance with the present inveniton with circuit elements.

Another embodiment of the present invention provides that the fiber bale or bales which are particularly hard to break up be identified as soon as possible after starting processing, for example, by weight. According to FIG. 2, a limit switch 11, 12 is fastened to the start and end of such fiber bales; their counterparts 9, 10 are fastened to the two deflection guide rollers 15,16 of a needle table 2. As soon as the counterpart (stop) 9 actuates the limit switch 11, the speed of needle table 2 is accelerated. Needle tables 2, 3 continue to move in the working direction. If the counterpart (stop) 10 actuates the limit switch 12, the rotary speed of needle table 2 is reduced again so that both needle tables 2, 3 again have the same rotary speed. Limit switches 11, 12 and the counterparts (stop) 9, 10 are connected to a selector switch 13 which is connected to motor 8.

Figure 3:
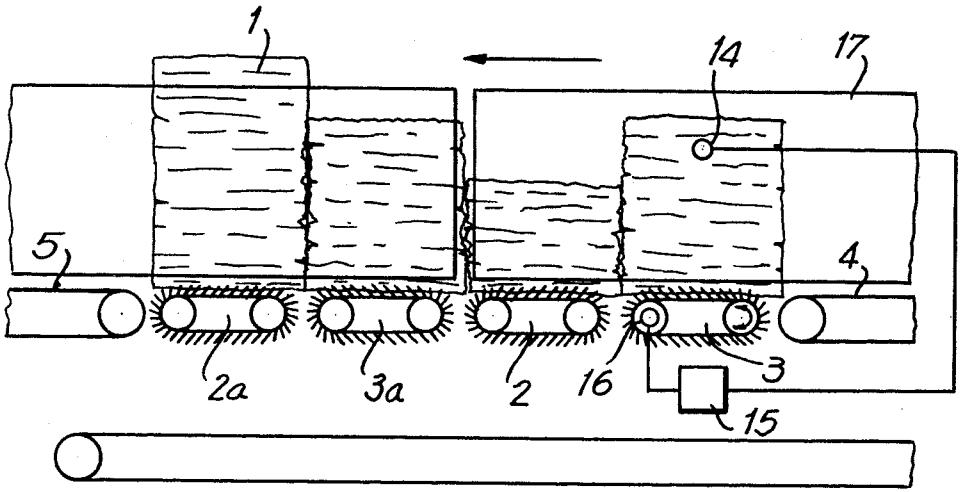
FIG. 3 is a schematic view and shows a further embodiment of the apparatus of the present invention.

In accordance with a further embodiment of the present invention shown in FIG. 3, two pairs of needle tables 2, 3; 2a, 3a are arranged underneath a row of adjacent textile fiber bales 1. The length of each needle table 2, 3; 2a, 3a is approximately equal to the length of one textile fiber bale 1. The textile fiber bales 1 lie directly on the needle tables 2, 3; 2a, 3a and are moved back and forth by them during the break-up process, the needle tables 2, 3; 2a, 3a are on the outside ends of the apparatus. Above needle table 3 which is associated with bale transport table 4 on the delivery side, a light barrier 14 is installed in the lateral guide wall 17 of the bale opener at a height of, say, 50 cm. If a bale 1, because of its height, covers the light barrier 14, a pulse is fed via a control unit 15 as input variable to motor 16 as correcting element. Motor 16 drives the needle table 3 and thus moves the needle belt of needle table 3. Because of the signal, motor 16 imparts a higher speed to the needle belt of needle table 3. It is important that, as a result, needle tables 2, 3; 2a, 3a run at different speeds. When bale 1 is again lower than light barrier 14, the rotary speed of the needle table 3 is again reduced so that the needle tables 2, 3; 2a, 3a again have the same rotary speed.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adapations should and are intended to be comprehended within the meaning and range of equivalence of the following claims.

What is claimed is:

1. A process for opening of textile fiber bales, by which a row of bales are loosened on their undersides and separated, said process employing rotary pairs of needle tables having needles, whereby the rotational speed of said needle tables is varied, said process comprising the steps of: altering the rotary speed of at least one pair of needle tables temporarily in response to textile fiber bale hardness characteristics, and varying said speed from a relative zero speed between the needles and bales.

2. A process according to claim 1, comprising the steps of: determining said working characteristics by selecting a bale material variable property as taken from the textile fiber bales, said variable being that which produces a regulated quantity in response to the rotary speed of the needle tables.

3. A process according to claim 1 including the steps of: determining hardness characteristics of the textile fiber bales as a measurement of variation in bale properties.

4. A process according to claim 1 including the steps of: weighing the textile fiber bales for determining said variation in bale properties.

5. An apparatus for opening textile bales where a row of textile fiber bales are loosened on their undersides, separation is effected by a separation assembly, defined by; rotary pairs of needle tables, said needle tables having a varying rotatable speed wherein: a measuring element is provided for ascertaining a, bale property, said element is attached through an operating mechanism to a final controlling element for changing rotary speed of said needle tables by temporarily varying said speed to a relative zero speed between needles and bales.

6. An apparatus as claimed in claim 5 wherein: a power drivable needle element is provided for detection of the bale property and a motor means is provided for reversing rotational movement of said needle tables.

7. An apparatus as claimed in claim 5 wherein: first control elements are affixed through intermediate counter members to a needle table and said control elements are connected to motor means through a reverse switch.

* * * * *